US005852900A

United States Patent [19]

Edelman

[11] Patent Number: 5,852,900

[45] Date of Patent: Dec. 29, 1998

[54] ROOF GUTTER ASSEMBLY

[76] Inventor: William J. Edelman, 175 Linda Ave., Hawthorne, N.Y. 10532

[21] Appl. No.: 790,159

[22] Filed: Jan. 28, 1997

Related U.S. Application Data

[63] Continuation-in-part of Ser. No. 604,028, Feb. 20, 1996.

[51] Int. Cl.[6] ..... E04D 13/076

[52] U.S. Cl. ..... 52/12

[58] Field of Search ..... 52/12, 11, 15, 52/16; 210/163, 473, 474, 477

[56] References Cited

U.S. PATENT DOCUMENTS

| | | | |
|---|---|---|---|
| 4,404,775 | 9/1983 | Demartini . | |
| 4,406,093 | 9/1983 | Good et al. . | |
| 4,551,956 | 11/1985 | Axford . | |
| 4,757,649 | 7/1988 | Vahldieck . | |
| 4,858,396 | 8/1989 | Rose et al. . | |
| 4,866,890 | 9/1989 | Otto . | |
| 4,876,827 | 10/1989 | Williams . | |
| 5,332,332 | 7/1994 | Kenyon, Jr. . | |
| 5,497,583 | 3/1996 | Rhoads | 52/12 |
| 5,575,118 | 11/1996 | Vahldieck | 52/12 |
| 5,588,261 | 12/1996 | MacConochie | 52/12 |
| 5,595,027 | 1/1997 | Vail | 52/12 |

FOREIGN PATENT DOCUMENTS

| | | | |
|---|---|---|---|
| 1509127 | 8/1969 | Germany | 52/12 |
| 5002100 | 1/1995 | WIPO | 52/12 |

*Primary Examiner*—Michael Safavi

*Attorney, Agent, or Firm*—Ohlandt, Greeley, Ruggiero & Perle

[57] ABSTRACT

A roof gutter assembly constructed to define a gutter having a gap between its front wall and the front edge of a downwardly sloping shield; and with a removably mounted tubular member within the gutter extending from the front edge of the shield for reducing the size of the gap such that large debris is prevented from entering and substantially only water is received in the gutter.

3 Claims, 3 Drawing Sheets

FIG.1
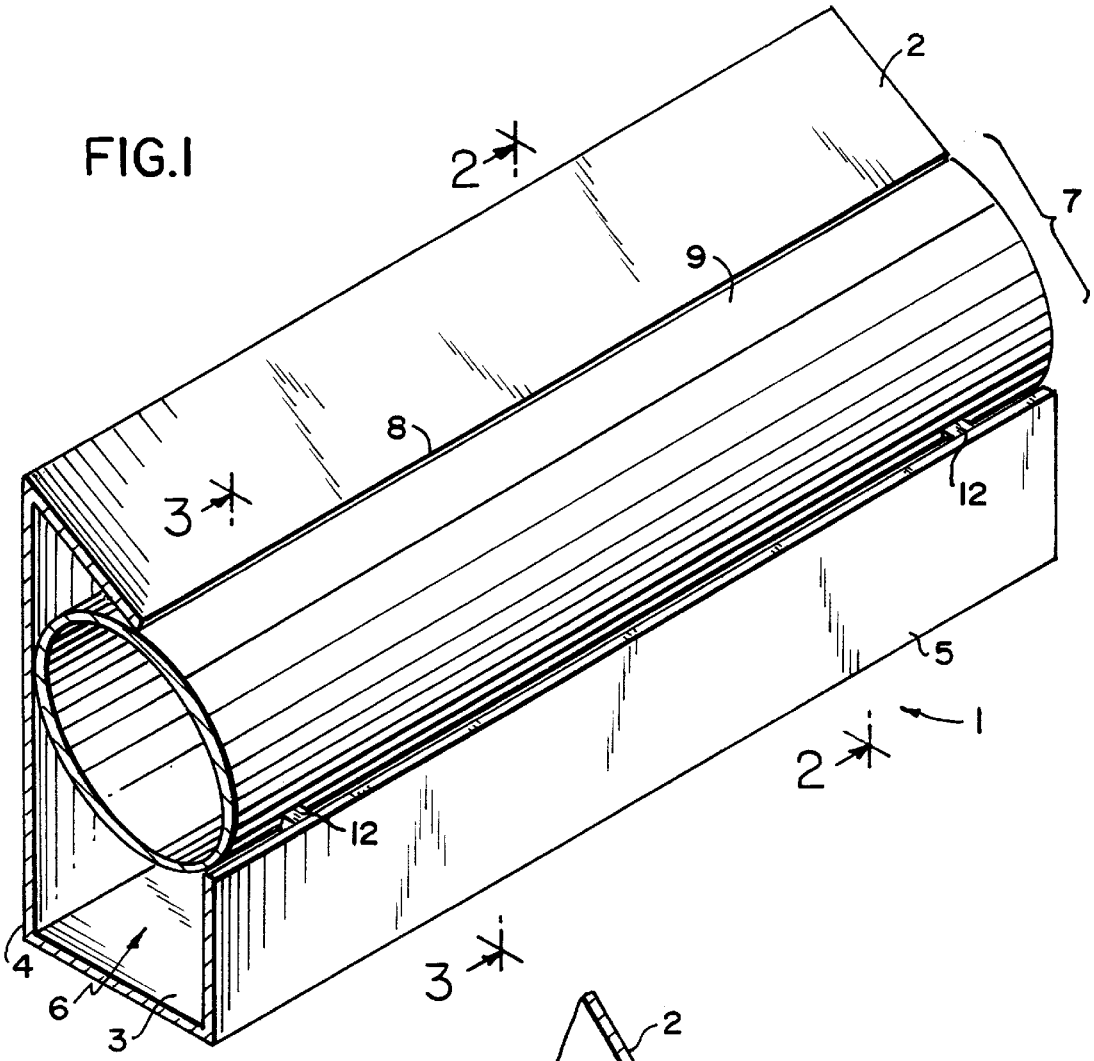
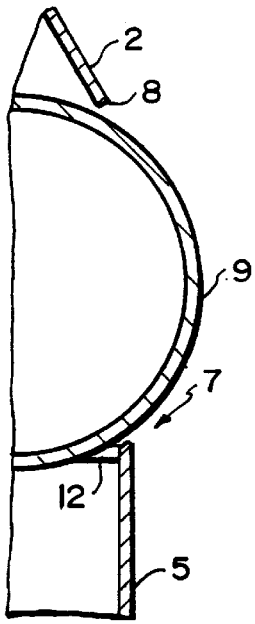
FIG.3

ROOF GUTTER ASSEMBLY

This is a Continuation-In-Part of U.S. patent application Ser. No. 08/604,028, filed Feb. 20, 1996, the benefit of whose filing date for common subject matter is herewith claimed.

FIELD OF THE INVENTION

This invention relates to a roof gutter assembly. More particularly, the invention is directed to a roof gutter assembly that provides for the efficient channeling of rainwater from the roof of a house to a downspout and includes means for preventing the gutter from clogging with debris, such as leaves and the like.

DESCRIPTION OF THE PRIOR ART

It is a common practice to provide houses with gutters along the roof edge to channel rainwater from the roof into downspouts to prevent the water from penetrating the walls of the house and causing damage. Conventional known gutters are formed as open-topped troughs. Such troughs collect leaves, seeds and dirt which can clog the gutters. To minimize this problem, the prior art teaches the use of screens or gutter guards. However, screens or gutter guards are not effective and make the cleaning of the gutters more difficult. In addition, the screens or gutter guards themselves can collect dirt and debris, causing a buildup of ice and snow, the weight of which has been known to cause the collapse of the gutter.

A number of means for minimizing the amount of debris received in the gutter have been proposed. These prior art devices, however, have not been found to be particularly effective and/or have failed to provide easy access to the interior of the gutter for periodic cleaning.

U.S. Pat. No. 4,757,649 to Vahldiek discloses a gutter system in which an upper shield is provided in the form of a continuous double-curved convolute curve. The shield allows leaves and debris present in the runoff from the roof to be directed away from the gutter, the rainwater itself traveling along the curve of the shield to be deposited in the gutter. Although such a device may be somewhat successful in preventing leaves in the runoff from entering the gutter, the gutter remains susceptible to clogging with blowing leaves and other such debris that enter through the large gap between the shield and the gutter. Another approach to the prevention of clogged gutter is shown in U.S. Pat. No. 5,406,755 to Serano and U.S. Pat. No. 4,404,775 to Demartini. These patents teach the use of a deflector having an arcuate surface that moves leaves included in roof runoff away from the gutter, and limits the size of the gap between the deflector and the gutter. The deflectors of these patents, however, are separate from the gutter, and require mounting beneath the roof shingles which makes retrofitting difficult. Further, the narrowed gap between the deflector and the gutter prevents the periodic cleaning of small debris from the gutter. Such small debris can accumulate and eventually clog the gutter.

Other prior art attempts at providing means for preventing the clogging of a roof gutter are described in, for example, U.S. Pat. Nos. 5,522,183; 5,406,754; 5,388,377; 5,332,332; 5,327,689; 5,242,591; 4,876,827; 4,866,890; 4,858,396; 4,592,174; 4,590,716; 4,571,896; 4,551,956; 4,406,093; 3,507,396; 3,079,000; 3,507,396; and 2,533,402, as well as German Patent No. 1,509,127.

None of these patents, however, describe a gutter assembly that effectively prevents the clogging of gutters with leaves included in roof runoff and blowing leaves, while, at the same time allows easy access to the gutter for periodic removal of small debris that inevitably collects within the gutter.

Accordingly, it is a fundamental object of the present invention to provide a gutter assembly that effectively prevents large debris, from entering the gutter.

It is a further object of the present invention to provide a gutter assembly that effectively prevents large debris from entering the gutter while, at the same time, allows easy access to the gutter for periodic cleaning.

An additional object of the invention to provide a rain gutter assembly that acts as a single unit, the mounting of which does not require the removal of any roof shingles.

SUMMARY OF THE INVENTION

Briefly described, the roof gutter assembly of the present invention includes, as a first component, a longitudinally extending main body having a shield, a floor and a back wall extending between the shield and the back wall. A front wall extends upwardly from the floor to define a gutter and a gap between the front wall and a front edge of the shield. A second component of the inventive assembly comprises a separable arcuate means that engages with, and extends from the front edge of the shield. The arcuate means reduces the size of the gap between the front wall and the front edge of the shield such that large debris is prevented from entering and substantially only water is received in the gutter.

In a preferred embodiment of the invention, the arcuate means is a tubular member detachably attached within the main body via a plurality of J-hooks. By detaching the tubular member, easy access is provided to the interior to allow for the periodic cleaning of small debris from the gutter.

Other and further objects, advantages and features of the present invention will be understood by reference to the following specification, considered in conjunction with the annexed drawings, wherein like parts have been given like numbers.

BRIEF DESCRIPTION OF THE DRAWINGS

FIG. 1 is a perspective view of one preferred embodiment of the inventive roof gutter assembly.

FIG. 3 is a side, sectional view of the roof gutter assembly shown in FIG. 1, taken on the line 3—3 thereof.

DESCRIPTION OF THE PREFERRED EMBODIMENTS

Figure 2:
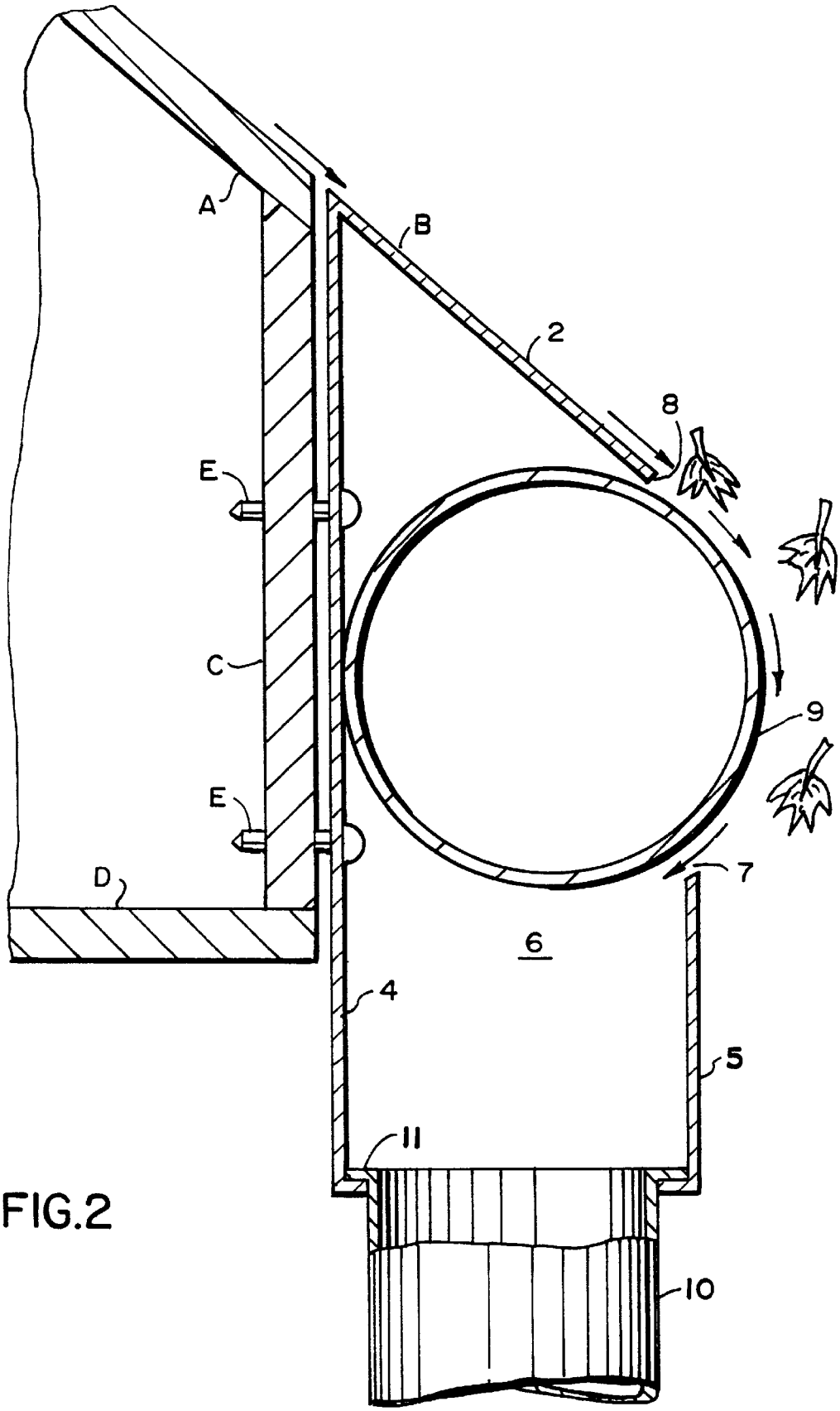
FIG. 2 is a side, sectional view of the roof gutter assembly shown in FIG. 1, taken on the line 2—2 thereof.

FIG. 1 illustrates one preferred embodiment of a roof gutter assembly of the present invention. The roof gutter assembly comprises a one piece, longitudinally extending main body 1 having a shield 2, a floor 3, and a back wall 4 extending between shield 2 and floor 3. A front wall 5 extends upwardly from floor 3 to define a gutter 6 having a gap 7 between front wall 5 and a front edge 8 of shield 2.

A separable arcuate means 9 engages with, and extends from, front edge 8 of shield 2, reducing the size of gap 7 such that large debris is prevented from entering and substantially only water is received in gutter 6.

The mounting and function of the inventive roof gutter assembly are best shown with reference to FIG. 2. Main body 1 can be attached to a facia board C, extending between the roof A and soffet D of the house by screws E or other standard fastening means such that shield 2 is positioned below, and substantially parallel to the last course of roof shingle B. Preferably, shield 2 will slope toward front edge 8 at an angle similar to that of the roof.

Water and debris shed from roof A are carried down along shield 2 to arcuate means 9. Leaves and other debris continue to travel in a straight line and are ejected from the roof while surface cohesion causes the downward flowing water to travel along the exterior of arcuate means 9 to be deposited in gutter 6 through gap 7. The rainwater is then channeled to downspout 10, provided at intervals in floor 3, and held in place by downspout flange 11. Because the size of gap 7 is reduced by the positioning of arcuate means 9, blowing leaves and other debris are, to a great extent, prevented from entering gutter 6. To maintain gap 7 at a predetermined size, spacer blocks 12 can be provided at intervals along a top edge of front wall 5, as shown in FIGS. 1 and 3. As an alternative, raised rings (not shown) can be provided at intervals along the length of the arcuate means. When such spacer blocks or rings are used, the arcuate means can be held in place by a slight compressive force provided between the shield. the back wall and the front wall.

The one piece main body can be formed of any standard guttering material including plastic, aluminum, or fiberglass. Preferably, the arcuate means is in the form of a tubular member which can be formed of the same materials described above. The circular cross-section of the tubular member provides strength, even when formed of lightweight materials. Each of the main body and the tubular member can be formed in convenient lengths that can be joined together at the ends thereof. The end of any section of main body and/or tubular member can be capped where needed.

Although the tubular member will prevent a majority of larger debris such as leaves and even such things as the nests of bats, yellow jackets and other insects from entering the gutter, it is inevitable that some small debris, such as seeds and shingle sand, will enter through the gap and accumulate over time. Thus, periodic cleaning of the gutter is required. To make periodic cleaning as effortless as possible, in a preferred embodiment of the invention, the tubular member normally disposed substantially within the main body is adapted to be separated and at least partially removed therefrom to allow for easy access to the gutter interior.

Figure 4:
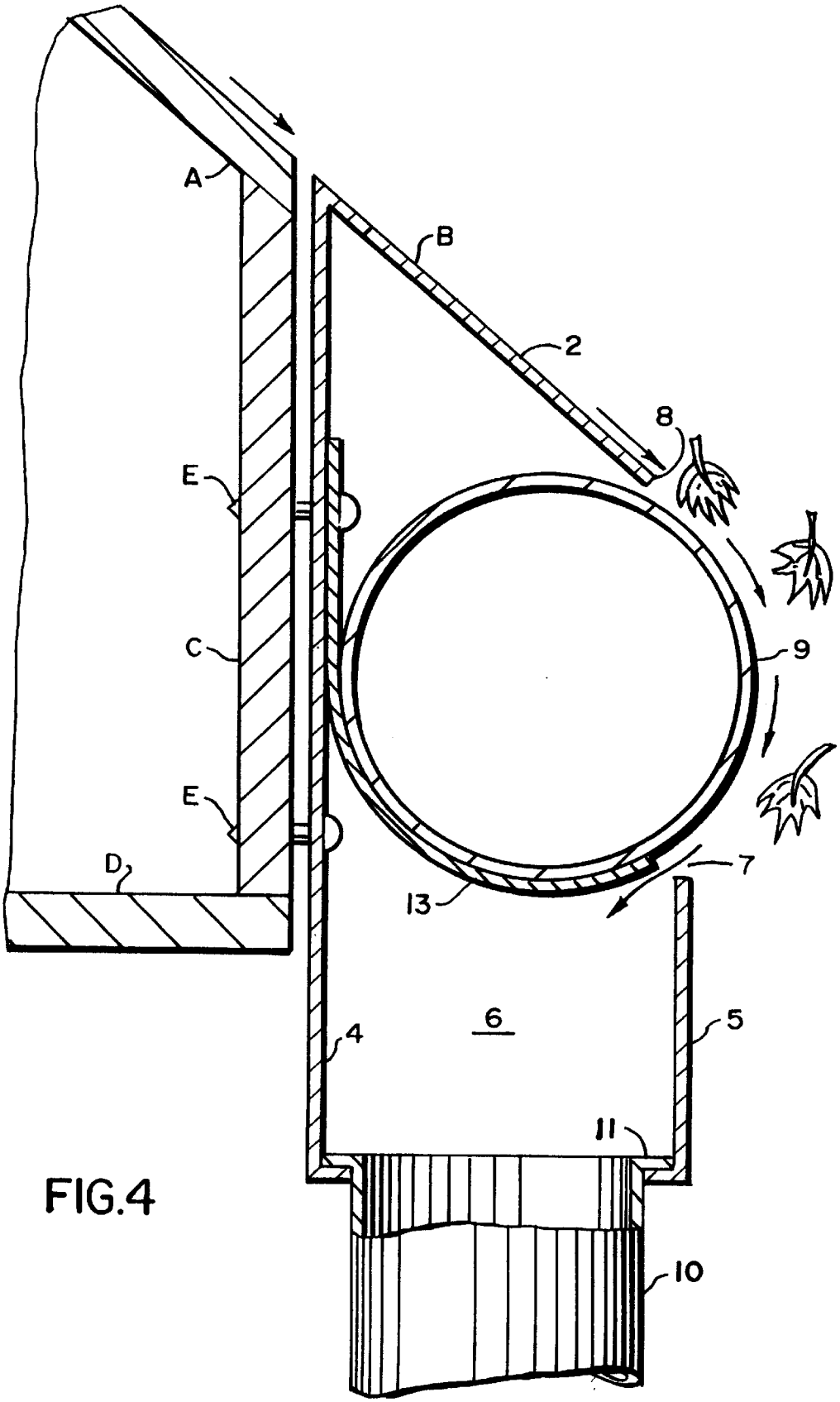
FIG. 4 is a side, sectional view of another preferred embodiment of the invention.

In the embodiment of the invention shown in any of FIGS. 2 or 3, the tubular member can be removed by pulling it through the gap against the force of the shield and front wall. In another preferred embodiment of the invention, as shown in FIG. 4, arcuate means 9, in the form of a tubular member, is detachably attached to back wall 4 of main body 1 via a plurality of J-hooks 13, provided at spaced intervals along the length of main body 1. The tubular member can be pulled from the J-hooks and thence removed from main body 1 to provide full access to, and the easy cleaning of, gutter 6.

While the invention has been described with particular reference to the preferred forms thereof, it will be obvious to one of ordinary skill in the art that various changes and modifications may be made therein without departing from the spirit and scope of the invention as defined in the appended claims.

What is claimed:

1. A roof gutter assembly comprising:

a longitudinally extending main body having a floor, a back wall extending upwardly from said floor, a shield extending from the top of said back wall and sloping downwardly to a distal front edge, a front wall extending upwardly from the floor to define a gutter having a gap between said front wall and the distal front edge of said shield; and a removably mounted tubular member normally disposed substantially within the main body, said tubular member engaging with, a extending from, the distal front edge of said shield for reducing the size of said gap such that large debris is prevented from entering and substantially only water is received in said gutter.

2. The roof gutter assembly of claim 1, wherein said front wall has a top edge, and the tubular member is removably mounted within the main body by means of spacers on the top edge of the front wall.

3. The roof gutter assembly of claim 1, wherein said tubular member is removably mounted within the main body via a plurality of spaced J-hooks.

* * * * *